US010415887B2

(12) United States Patent
Liu et al.

(10) Patent No.: US 10,415,887 B2
(45) Date of Patent: Sep. 17, 2019

(54) FIN AND MICRO-CHANNEL HEAT EXCHANGER

(71) Applicant: DUNAN ENVIRONMENT TECHNOLOGY CO., LTD, Hangzhou, Zhejiang (CN)

(72) Inventors: Huazhao Liu, Zhejiang (CN); Feng Wang, Zhejiang (CN)

(73) Assignee: DUNAN ENVIRONMENT TECHNOLOGY CO., LTD, Hangzhou (CN)

( * ) Notice: Subject to any disclaimer, the term of this patent is extended or adjusted under 35 U.S.C. 154(b) by 0 days.

(21) Appl. No.: 15/782,813

(22) Filed: Oct. 12, 2017

(65) Prior Publication Data

US 2018/0106549 A1 Apr. 19, 2018

(30) Foreign Application Priority Data

Oct. 17, 2016 (CN) ..... 2016 1 0905058

(51) Int. Cl.

| | |
|---|---|
| ***F28D 1/053*** | (2006.01) |
| ***F28F 9/02*** | (2006.01) |
| ***F28F 1/12*** | (2006.01) |
| *F28D 21/00* | (2006.01) |
| *F28F 17/00* | (2006.01) |
| *F28D 1/02* | (2006.01) |

(52) U.S. Cl.

CPC ..... *F28D 1/05366* (2013.01); *F28F 1/126* (2013.01); *F28F 9/0212* (2013.01); *F28D 2001/0273* (2013.01); *F28D 2021/007* (2013.01); *F28D 2021/0071* (2013.01); *F28F 17/005* (2013.01); *F28F 2009/0292* (2013.01)

(58) Field of Classification Search

CPC ..... F28D 1/05366; F28D 2001/0273; F28D 2021/007; F28D 2021/0071; F28F 1/126; F28F 9/0212; F28F 17/005; F28F 2009/0292

USPC ..... 165/152

See application file for complete search history.

(56) References Cited

U.S. PATENT DOCUMENTS

| | | | | |
|---|---|---|---|---|
| 2,329,789 A * | 9/1943 | Schank | B21D 53/04 | 29/890.045 |
| 4,375,832 A * | 3/1983 | Asselman | B21D 53/08 | 165/152 |
| 5,511,610 A * | 4/1996 | Lu | F28F 1/128 | 165/152 |
| 6,189,607 B1 * | 2/2001 | Hosoya | F28D 1/05366 | 165/109.1 |

(Continued)

*Primary Examiner* — Raheena R Malik

(57) ABSTRACT

The present invention discloses a fin and a micro-channel heat exchanger. A retractable fin in a bending region of the micro-channel heat exchanger comprises a plurality of fin unit sections which are sequentially connected to form a corrugated structure, each fin unit section comprises a first straight section and an arc top section, and a retractable section which is deformed due to stretching/squeezing in a bending process of the micro-channel heat exchanger is provided between the first straight section and the arc top section. The retractable sections of the retractable fin are gradually straightened in the bending process of the micro-channel heat exchanger, included angles between the retractable sections and adjacent straight sections gradually become small, and this thereby ensures that the retractable fin in the bending region is not stretch-broken.

8 Claims, 5 Drawing Sheets

(56) References Cited

U.S. PATENT DOCUMENTS

| | | | | |
|---|---|---|---|---|
| 6,968,891 | B2 * | 11/2005 | Tochigi | B21D 13/04<br>165/152 |
| 2005/0077033 | A1 * | 4/2005 | Schmalzried | F02B 29/0462<br>165/152 |

* cited by examiner

FIN AND MICRO-CHANNEL HEAT EXCHANGER

CROSS REFERENCE TO RELATED APPLICATIONS

The present application claims the benefit of Chinese Patent Application No. 201610905058.X filed on Oct. 17, 2016. All the above are hereby incorporated by reference.

FIELD OF THE INVENTION

The present invention relates to an air conditioning technique, in particular to a heat exchanger.

FIELD OF THE INVENTION

A micro-channel heat exchanger consists of header pipes, micro-channel flat pipes and fins, and has the advantages such as light weight, compact structure, high heat exchange efficiency, all-aluminum structure and convenience in recovery, and the like; and at the same time, an internal volume of the micro-channel heat exchanger is small, the filling amount of refrigerant is greatly reduced, the industrial trend of energy saving and environmental protection is satisfied and thus the micro-channel heat exchanger is widely applied to commercial/domestic air conditioner fields.

In order to obtain corresponding heat exchange amount and energy-efficiency ratio in a limited unit space, an evaporator and a condenser in an air conditioner often need to be bent to a certain angle to increase a heat exchange area, so as to satisfy the performance requirement during air conditioner design. Commonly seen bent shapes generally include an L-shape, a C-shape, a U-shape and the like. Air conditioning units in the current market are mostly heat-pump air conditioners which consider refrigeration and heating at the same time. In order to satisfy the demands of air conditioning units for drainage performance during operation in winter, the micro-channel heat exchange is generally designed in such a way that the header pipes are horizontally disposed, and the flat pipes and the fins are vertically disposed. Therefore, the micro-channel heat exchanger needs to be bent along a length direction of the header pipes to form a structure having a designated angle. In a bending process of a traditional micro-channel heat exchanger, fins on an inner side of a bend are squeezed, deformation such as inverted fins and distortion and the like occurs and the circulation of air is thereby obstructed; and fins on an outer side of the bend are stretched, situations such as stretching deformation and even tearing and the like occur, the appearance of the heat exchanger is seriously influenced, and at the same time, since the fins are torn, the heat exchange performance of the heat exchange is decreased.

Therefore, how to decrease the influence of bending on the performance of the micro-channel heat exchanger when the micro-channel heat exchange is bent along a direction towards the header pipes is an important problem which needs to be solved in this field.

SUMMARY OF THE INVENTION

The technical problem to be solved by the present invention is to provide a fin and a micro-channel heat exchanger, so as to decrease the influence of bending on the performance of the micro-channel heat exchanger when the micro-channel heat exchanger is bent along a direction towards header pipes.

In order to solve the above-mentioned technical problem, the present invention adopts the following technical solution: a fin comprises a plurality of fin unit sections which are sequentially connected to form a corrugated structure, each fin unit section comprises a first straight section and an arc top section, and a retractable section which is deformed due to stretching/squeezing in a bending process of the micro-channel heat exchanger is provided between the first straight section and the arc top section.

Preferably, the retractable section is of an arc concave structure.

Preferably, a second straight section between the arc top section and the retractable section is further provided.

Preferably, along an extension direction of the fin, a minimum spacing between adjacent first straight sections is L, a maximum spacing between adjacent second straight sections is L1, and L is greater than L1.

Preferably, the fin unit section on an outer side of a bend consists of three parts, i.e., an arc top section, a straight section and a retractable section, and the fin unit section on an inner side of the bend consists of an arc top section and a straight section.

Preferably, a length and an angle of the retractable section on the inner side of the bend are smaller than a length and an angle of the retractable section on the outer side of the bend.

Preferably, a width of the fin is greater than or equal to a width of a flat pipe.

Preferably, the first straight section is provided with a louver structure used for enhancing heat exchange.

The present invention further provides a micro-channel heat exchanger, comprising flat plate regions and a bending region which is bent between two adjacent flat plate regions, wherein the bending region is provided with the above-mentioned fin.

Further, a fin provided in the flat plate region comprises straight sections and arc top sections which are connected with the straight sections, and the straight sections are provided with louver structures used for enhancing heat exchange.

In the technical solution adopted by the present invention, a retractable fin is provided in a corresponding bending region in the bending process of the micro-channel heat exchanger, retractable sections of the retractable fin are gradually straightened in the bending process of the micro-channel heat exchanger, included angles between the retractable sections and adjacent straight sections gradually become small, and this thereby ensures that the retractable fin in the bending region is not stretch-broken.

Therefore, the present invention well solves the problem of fin deformation caused when the heat exchanger is bent along the length direction of the header pipes, and can guarantee the performance and appearance of the heat exchanger as good as possible.

DESCRIPTION OF THE DRAWINGS

The present invention will be further described below in combination with the drawings and the embodiments.

DESCRIPTION OF THE EMBODIMENTS

Figure 1:
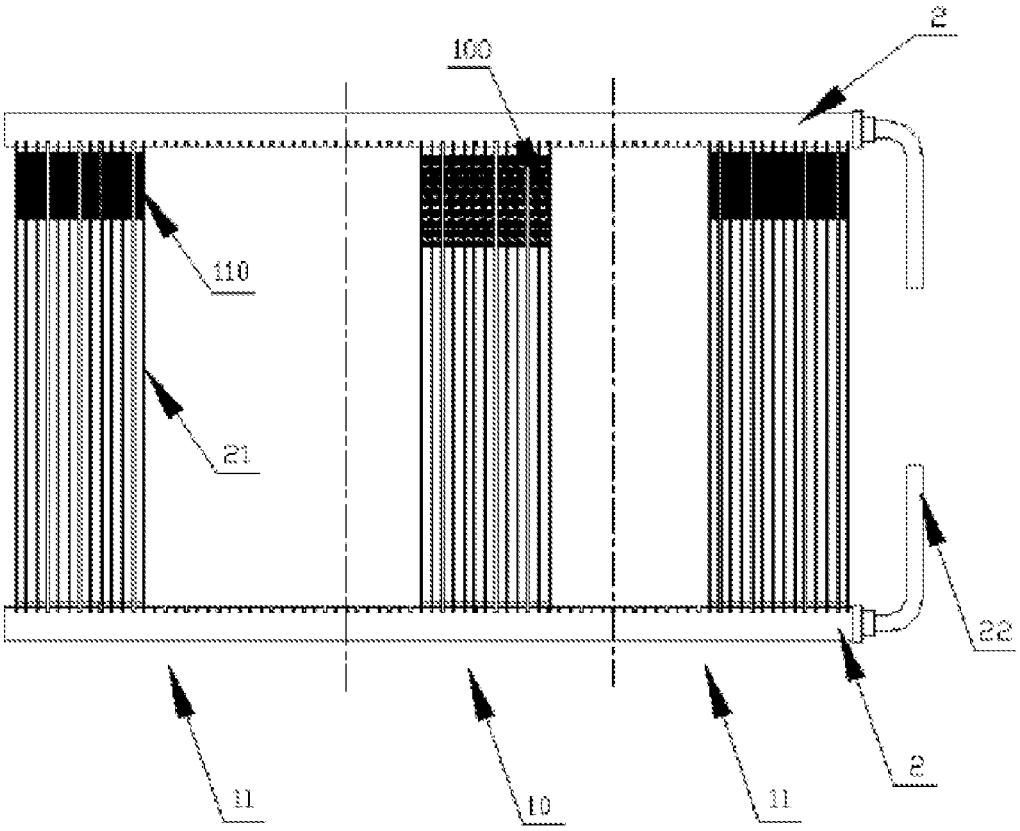
FIG. 1 is an overall structural view of a micro-channel heat exchanger.

Embodiment 1 as illustrated in FIG. 1, a micro-channel heat exchanger comprises header pipes 2, flat pipes 21 and fins, the flat pipes 21 are connected to the header pipes 2, the fins are installed between adjacent flat pipes, and end portions of the header pipes are connected with connecting pipes 22. The micro-channel heat exchanger is divided into a bending region 10 and flat plate regions 11 along a length direction of the header pipes 2, the bending region 10 is a region of the micro-channel heat exchanger for bending in a bending process, and the flat plate regions adopt common fins 110.

In view of the fact that fins on an inner side of a bend are squeezed in a bending process of a traditional micro-channel heat exchanger, deformation such as inverted fins and distortion and the like occurs and the circulation of air is thereby obstructed; and that fins on an outer side of the bend are stretched and situations such as stretching deformation and even tearing and the like occur, the bending region 10 adopts specially designed retractable fins 100.

Herein, the common fins 110 and the retractable fins 100 are all corrugated fins. Each of the common fins 110 and the retractable fins 100 comprises a plurality of fin unit sections which are sequentially connected to form a corrugated structure.

Figure 2:
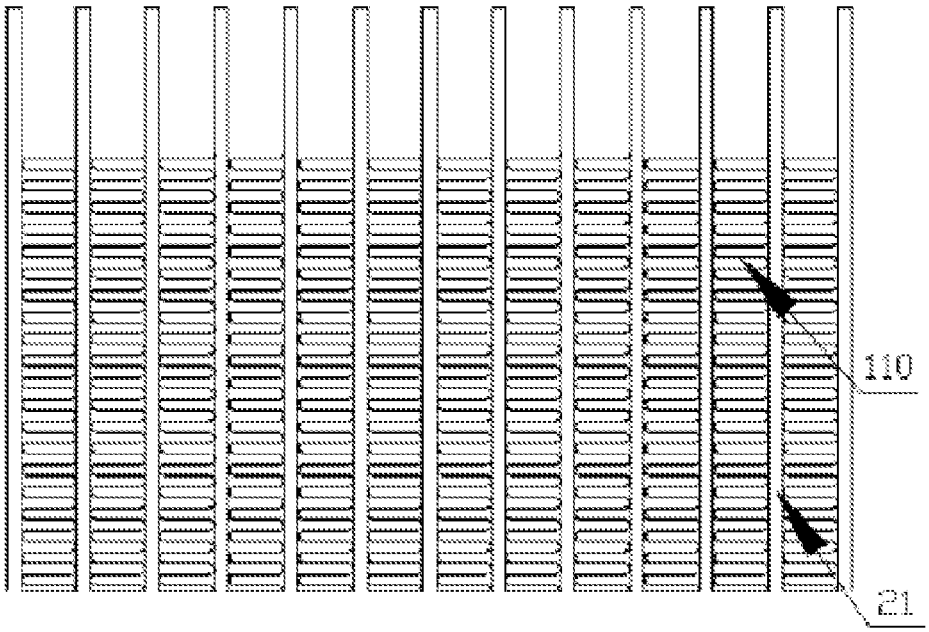
FIG. 2 is a schematic view of fins in a flat plate region and arrangement.
Figure 3:
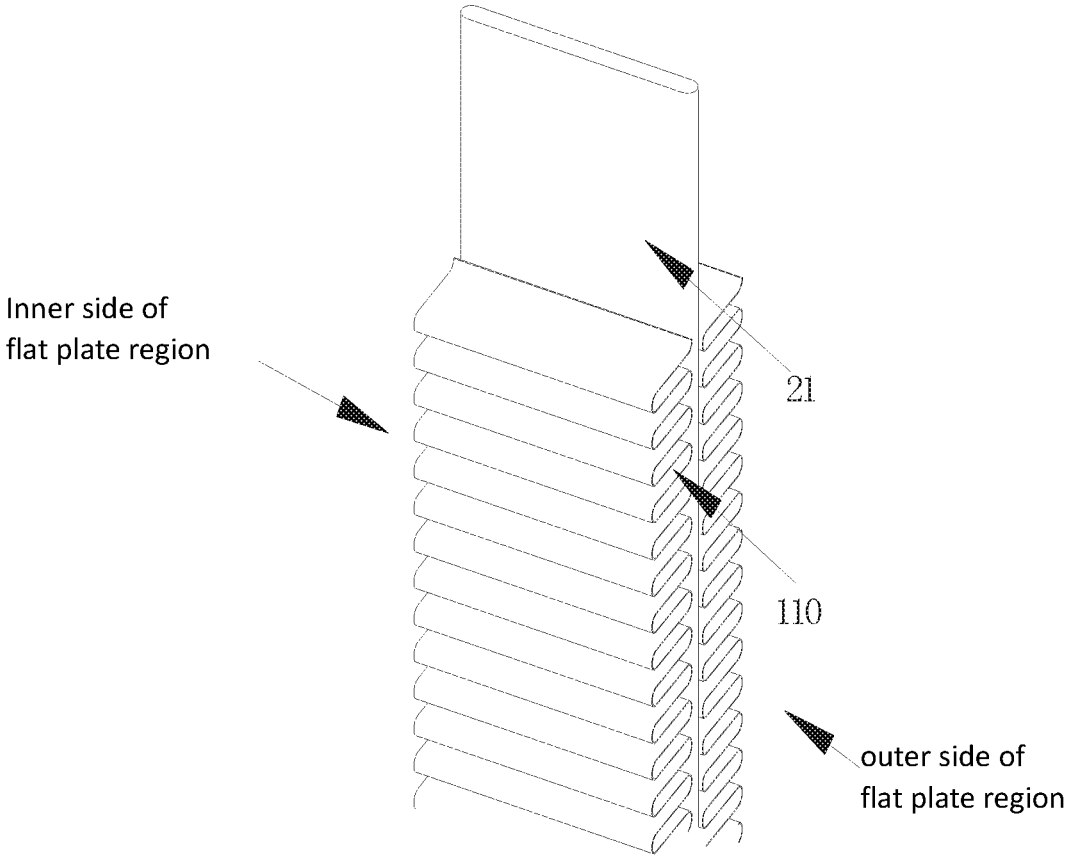
FIG. 3 is a partial view of fins and flat pipes in a flat plate region.
Figure 4:
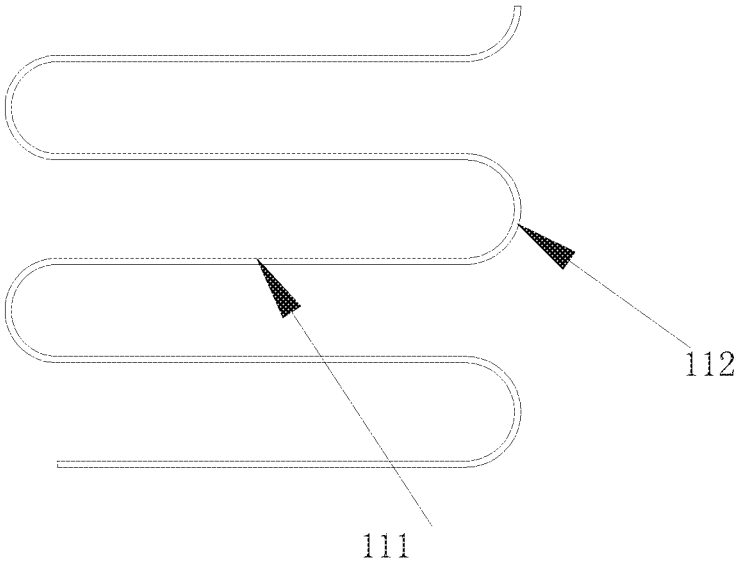
FIG. 4 is a structural schematic view of a common fin.

As illustrated in FIG. 2 to FIG. 4, each common fin 110 provided in the flat plate region 11 comprises straight sections 111 and arc top sections 112 which are connected with the straight sections 111, and the straight sections 111 are provided with louver structures used for enhancing heat exchange.

Figure 5:
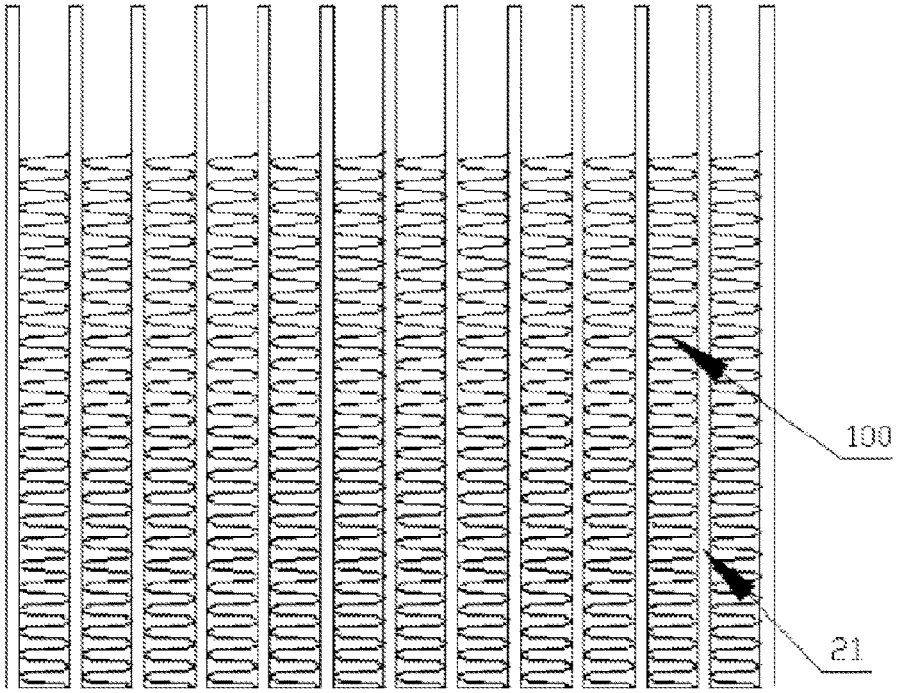
FIG. 5 is a schematic view of fins in a bending region and arrangement.
Figure 6:
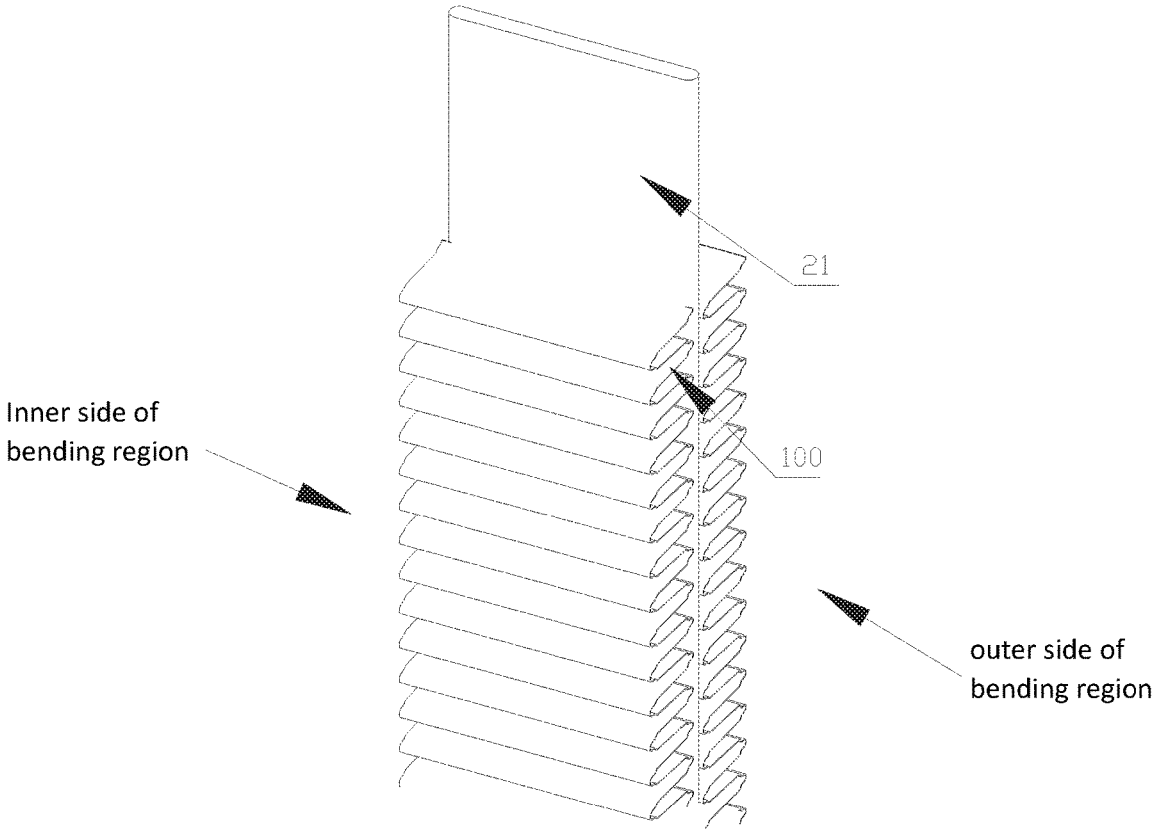
FIG. 6 illustrates a partial view of fins and flat pipes in a bending region.
Figure 7:
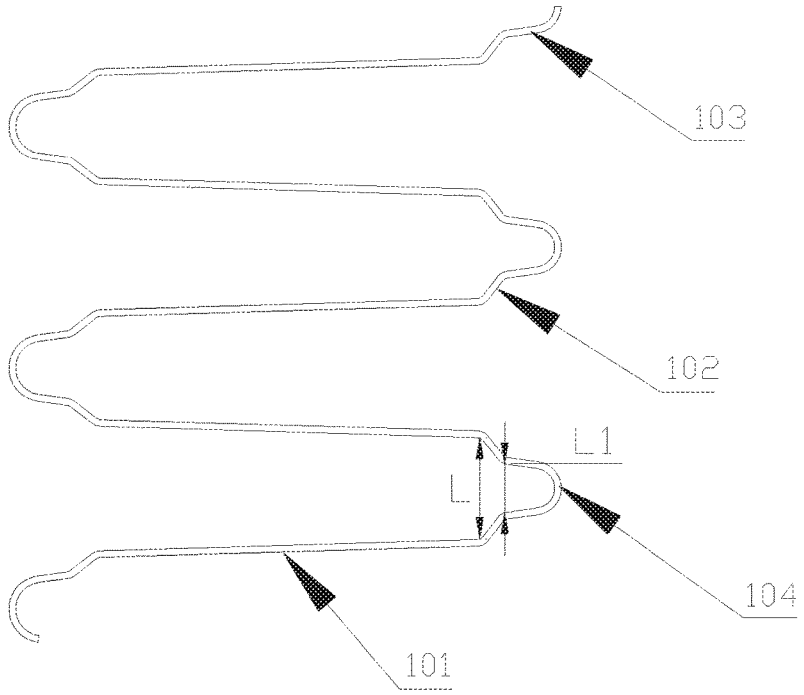
FIG. 7 is a structural schematic view of a retractable fin.

As illustrated in FIG. 5 to FIG. 7, in the retractable fins 100 provided in the bending region 10, the fin unit section comprises a first straight section 101 and an arc top section 104, and a retractable section 102 which is deformed due to stretching/squeezing in a bending process of the micro-channel heat exchanger is provided between the first straight section 101 and the arc top section 104. Further, a second straight section 103 between the arc top section and the retractable section is further provided.

Figure 8:
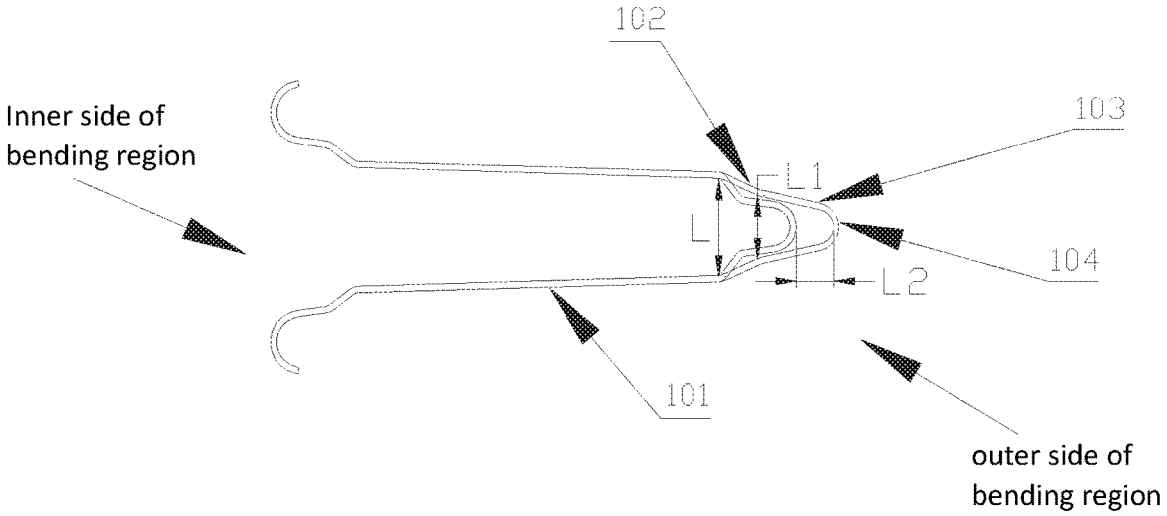
FIG. 8 is a comparison view of a retractable fin before and after bending.

As illustrated in FIG. 8, in the structure of the retractable fin 100, a minimum spacing between adjacent first straight sections 101 is L, a maximum spacing between adjacent second straight sections 103 is L1, and as compared with an equal spacing of the common fin 110, the spacing L of the retractable fin 100 is far greater than the spacing L1. By comparing the retractable fin in the bending region before and after bending, when the micro-channel heat exchanger is bent, the bending region is stressed and bent from a flat plate state to a curved surface having a certain radian, at this moment an arc length of an outer side of the bending region is greater than an arc length of an inner side of the bending region, at this moment the outer side of the bending region is stressed and stretched, and the inner side of the bending region is squeezed. Consequently, the retractable fin at a position close to an outer side of the bend in the bending region is stretched and deformed, and the retractable fin at a position close to an inner side in the bending region is squeezed and deformed. Since transition between the first straight section 101 and the second straight section 103 of the retractable fin is realized through the retractable section 102, in the bending process of the micro-channel heat exchanger, the retractable sections of the retractable fin are gradually straightened, included angles between the retractable sections and the straight sections gradually become small, at this moment a difference between L1 and L continuously decreases, an arc top of the retractable fin close to the outer side of the bend is elongated a distance L2 after the bending of the micro-channel heat exchanger is completed, and this thereby ensures that the retractable fin in the bending region is not stretch-broken.

Figure 9:
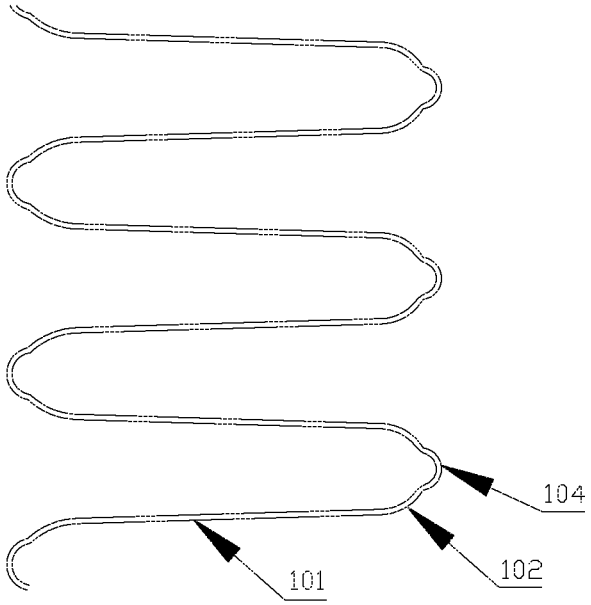
FIG. 9 is a structural view of a retractable fin in Embodiment 1.

Of course, as illustrated in FIG. 9, the structure of the second straight sections may not be provided, and only the retractable sections 102 are provided between the first straight sections 101 and the arc top sections 104.

In addition, it needs to be noted that the length and angle of the retractable sections of the retractable fin 100 on the inner side of the bend and the outer side of the bend may be respectively different. The width of the retractable fin and the width of the flat pipe may be different. Preferably, the length and angle of the retractable section on the inner side of the bend are smaller than the length and angle of the retractable section on the outer side of the bend, because the retractable fin 100 on the outer side of the bend is a major deforming position. Besides, the width of the retractable fin 100 is greater than or equal to the width of the flat pipe 21.

Figure 10:
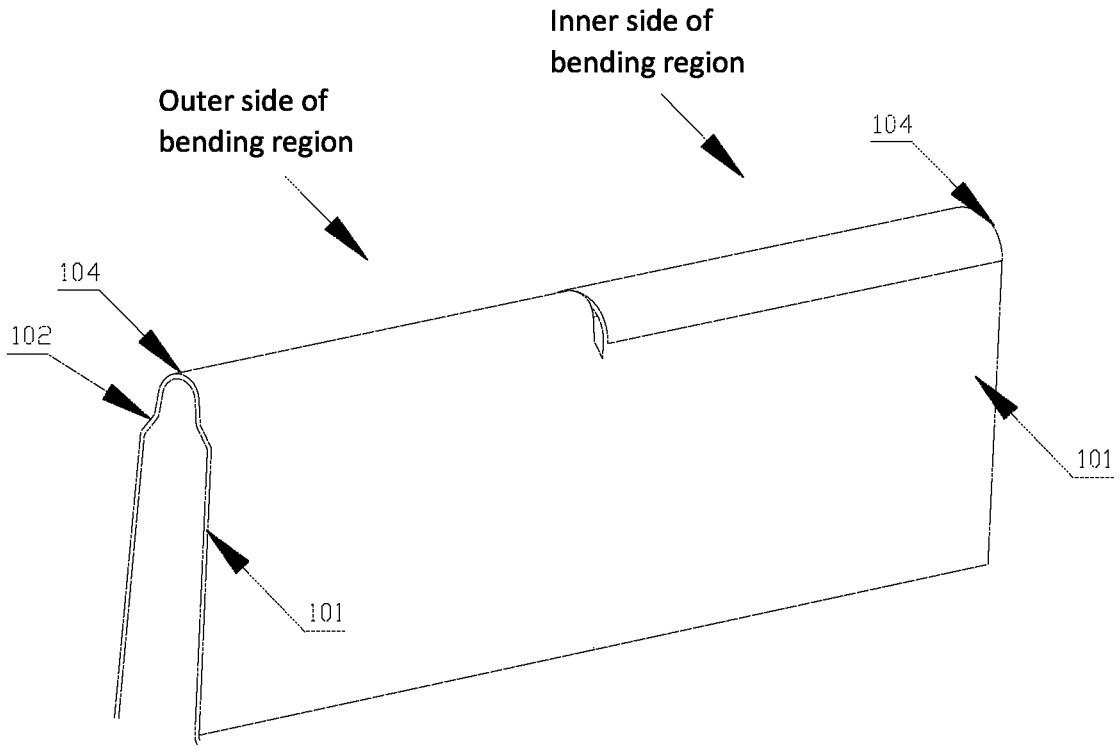
FIG. 10 is a structural view of a retractable fin in Embodiment 2.

Embodiment 2 as illustrated in FIG. 10, an overall structure of a retractable fin 100 is divided into two parts, one part is an outer side of a bending region and the other part is an inner side of the bending region, wherein a fin unit section on the outer side of the bending region consists of three parts, i.e., an arc top section 104, a straight section 101 and a retractable section 102 between the arc top section 104 and the straight section 101, a fin unit section on the inner side of the bending region consists of two parts, i.e., the arc top section 104 and the straight section 101, and the straight section is provided with a louver structure used for enhancing heat exchange. The retractable section 102 is provided because the retractable fin 100 on the outer side of the bending region is a major deforming position.

Moreover, a partition seam may be provided between the outer side of the bending region and the inner side of the bending region of the retractable fin 100, and seamless connection may also be adopted on the whole.

The invention claimed is:

1. A fin used in a micro-channel heat exchanger comprising flat plate regions and a bending region which is bent between two adjacent flat plate regions, wherein the fin comprises a plurality of fin unit sections which are sequentially connected to form a corrugated structure, each fin unit section comprises a first straight section, an arc top section, a retractable section and a second straight section, the retractable section is provided between the first straight section and the arc top section, allowing to be stretched/squeezed in the process of bending the micro-channel heat exchanger, and the second straight section is provided between the arc top section and the retractable section, the fin unit section on an outer side of the bending region consists of the arc top section, the first straight section, the retractable section and the second straight section, and the fin unit section on the an inner side of the bending region consists of the arc top section and the first straight section.

2. The fin according to claim 1, wherein the retractable section is of an arc concave structure.

3. The fin according to claim 1, wherein along an extension direction of the fin, a minimum spacing between adjacent first straight sections is L, a maximum spacing between adjacent second straight sections is L1, and L is greater than L1.

4. The fin according to claim 1, wherein a length and an angle of the retractable section on the inner side of the bend are smaller than a length and an angle of the retractable section on the outer side of the bend.

5. The fin according to claim 4, wherein a width of the fin is greater than or equal to a width of a flat pipe.

6. The fin according to claim 4, wherein the first straight section is provided with a louver structure used for enhancing heat exchange.

7. A micro-channel heat exchanger, wherein the bending region is provided with the fin according to claim 1.

8. The micro-channel heat exchanger according to claim 7, wherein a fin provided in the flat plate region comprises straight sections and arc top sections which are connected with the straight sections, and the straight sections are provided with louver structures used for enhancing heat exchange.

* * * * *